US007905178B2

(12) United States Patent
Dryer et al.

(10) Patent No.: US 7,905,178 B2
(45) Date of Patent: Mar. 15, 2011

(54) METHODS AND APPARATUS FOR SELECTABLE VELOCITY PROJECTILE SYSTEM

(75) Inventors: Richard Dryer, Oro Valley, AZ (US); Neal M Conrardy, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 1260 days.

(21) Appl. No.: 11/032,929

(22) Filed: Jan. 10, 2005

(65) Prior Publication Data

US 2010/0000438 A1 Jan. 7, 2010

(51) Int. Cl.
*F42B 5/16* (2006.01)

(52) U.S. Cl. ..... 102/443; 102/447; 102/490; 102/202; 102/202.6

(58) Field of Classification Search ..... 102/202, 102/443, 444, 447, 202.6, 217, 478, 490
See application file for complete search history.

(56) References Cited

U.S. PATENT DOCUMENTS

| | | | | | |
|---|---|---|---|---|---|
| 352,125 | A | * | 11/1886 | Graydon | 102/443 |
| 3,142,959 | A | * | 8/1964 | Klein | 60/250 |
| 3,283,719 | A | * | 11/1966 | Grandy | 102/443 |
| 4,619,202 | A | * | 10/1986 | Romer et al. | 102/443 |
| 5,031,541 | A | * | 7/1991 | Gardner et al. | 102/443 |
| 5,042,388 | A | * | 8/1991 | Warren et al. | 102/434 |
| 5,263,416 | A | * | 11/1993 | Amundson et al. | 102/202.9 |
| 5,353,710 | A | * | 10/1994 | Eches et al. | 102/443 |
| 5,767,439 | A | * | 6/1998 | Lindblom et al. | 102/472 |
| 5,880,397 | A | * | 3/1999 | Crilly | 102/443 |
| 6,158,348 | A | * | 12/2000 | Campoli | 102/443 |
| 6,543,362 | B1 | * | 4/2003 | Muskat | 102/202 |
| 6,708,621 | B1 | * | 3/2004 | Forichon-Chaumet et al. | 102/470 |

* cited by examiner

*Primary Examiner* — James S Bergin
(74) *Attorney, Agent, or Firm* — The Noblitt Group, PLLC

(57) ABSTRACT

Methods and apparatus according to various aspects of the present invention comprise a propelling system for propelling projectiles with variable velocity. In one embodiment, a cartridge comprises a cartridge case, the propelling system, and the projectile attached to the cartridge case.

28 Claims, 4 Drawing Sheets

METHODS AND APPARATUS FOR SELECTABLE VELOCITY PROJECTILE SYSTEM

BACKGROUND OF THE INVENTION

1. Field of the Invention

The invention pertains generally to methods and apparatus relating to propulsion systems.

2. Description of Related Art

Propelling systems find uses in a variety of applications, such as building tools, internal combustion engines, rockets used to launch satellites, missiles, or the like, and ammunition for weapons. Propelling systems have many different types of launch mechanisms. For example, conventional ammunition ignites volatile powders or pellets to produce expanding gases to propel the projectile. The projectile's velocity depends primarily on the type and amount of propellant used. In systems using cartridges having a cartridge, projectile, and propellant, such as cannon or small arms, the velocity of the projectile is fixed.

BRIEF SUMMARY OF THE INVENTION

Methods and apparatus according to various aspects of the present invention comprise a propelling system for propelling projectiles with selectable velocity. In one embodiment, the propelling system comprises a cartridge, a propelling system, and a projectile.

BRIEF DESCRIPTION OF THE DRAWING

A more complete understanding of the present invention may be derived by referring to the detailed description and claims when considered in connection with the figures, wherein like reference numbers refer to similar elements throughout the figures, and:

DETAILED DESCRIPTION OF EXEMPLARY EMBODIMENTS

Figure 1:
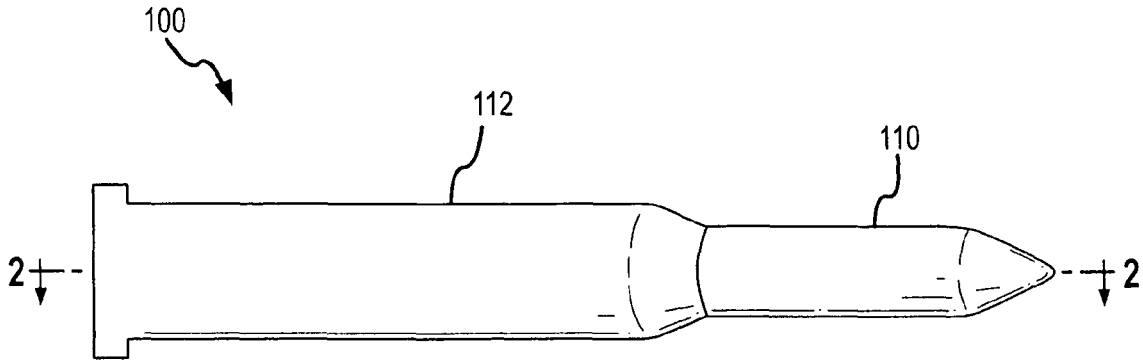
FIG. 1 is a diagram of an exemplary cartridge.

The present specification and accompanying drawings show an exemplary embodiment by way of illustration and best mode. While these exemplary embodiments are described, other embodiments may be realized, and logical and mechanical changes may be made without departing from the spirit and scope of the invention. Thus, the detailed description is presented for purposes of illustration only and not of limitation. For example, the steps recited in any of the methods or process descriptions may be executed in any suitable order and are not limited to the order presented. Further, conventional mechanical aspects and components of the individual operating components of the systems may not be described in detail. The representations of the various components are intended to represent exemplary functional relationships, positional relationships, and/or physical couplings between the various elements. Many alternative or additional functional relationships, physical relationships, or physical connections may be present in a practical system.

The present invention is described partly in terms of functional components and various methods. Such functional components may be realized by any number of components configured to perform the specified functions and achieve the various results. For example, the present invention may employ various materials, explosives, projectiles, propellants, ignition systems, shapes, sizes, and weights for various components, electronic components, mechanical components, and the like, which may carry out a variety of functions.

Various aspects of the present invention may be embodied as a customization of an existing system, an add-on product, or a distributed system. Software may be associated with the invention to perform functions such as, for example, timing and control. Accordingly, various aspects of the present invention may take the form of an embodiment combining aspects of both software and hardware. Furthermore, any program or other control functions associated with the present invention, such as for firing and/or controlling the system, may take the form of a computer program executed on any suitable computer, a program executed by dedicated hardware where the program may be stored on any type of medium such as a hard disk, optical storage, and/or the like, or a program embedded in hardware by way of memory or logic. In addition, the present invention may be practiced in conjunction with any number of applications and environments, and the systems described are merely exemplary applications of the invention. Further, the present invention may employ any number of conventional techniques for manufacture, ignition, deployment, and the like.

Methods and apparatus according to various aspects of the present invention comprise a munition or other projectile system having a propelling system. The propelling system may be used for any suitable purpose or combination of purposes, such as to move pistons in an internal combustion engine, propel nails from building construction tools, launch satellites into orbit, propel projectiles from weapon systems, or any other suitable application. The methods and apparatus may be adapted for any system propelling and/or moving an object for any purpose.

For example, a propelling system according to various aspects of the present invention may be part of a cartridge for a weapon system. In one embodiment, the cartridge comprises a cartridge case, a propelling system, and a projectile attached to the cartridge case. The cartridge may be configured to fire a guided projectile that may require some time between launch and acquiring a desired target. In a system where the muzzle velocity is substantially fixed, the guided projectile launched at a nearby target may pass the desired target before acquiring it, thus decreasing the effectiveness of the guided projectile for targets closer than a certain minimum distance. Accordingly, the propelling system may allow launching a projectile at a variety of launch velocities to enable the guided projectile to be slower and to acquire nearer targets.

Figure 2:
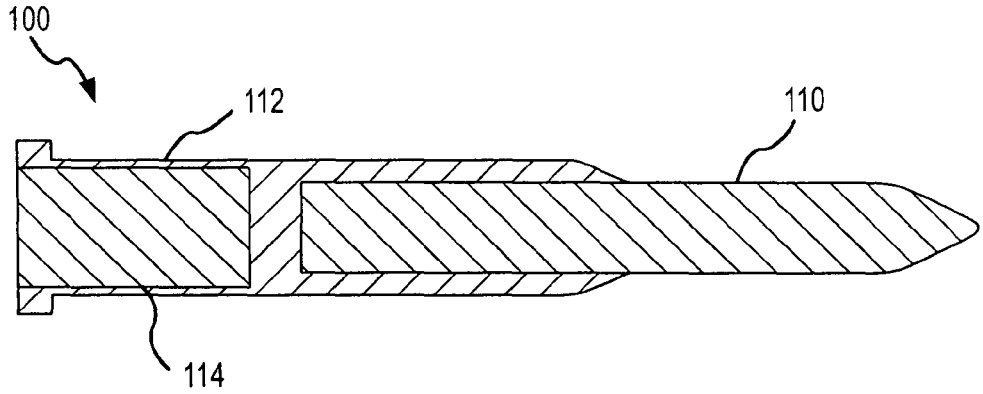
FIGS. 2 and 3 are cross-section diagrams of exemplary cartridges.

In particular, referring to FIGS. 1 and 2, a cartridge 100 according to various aspects of the present invention comprises a projectile 110, a cartridge case 112, and a propelling system 114. The projectile 110 is positioned at one end of the cartridge case 112, forming an interior enclosure within the cartridge case 112. When the propelling system 114 is activated, the propelling system 114 rapidly expands and pushes the projectile 110 away from the cartridge case 112.

Figure 4:
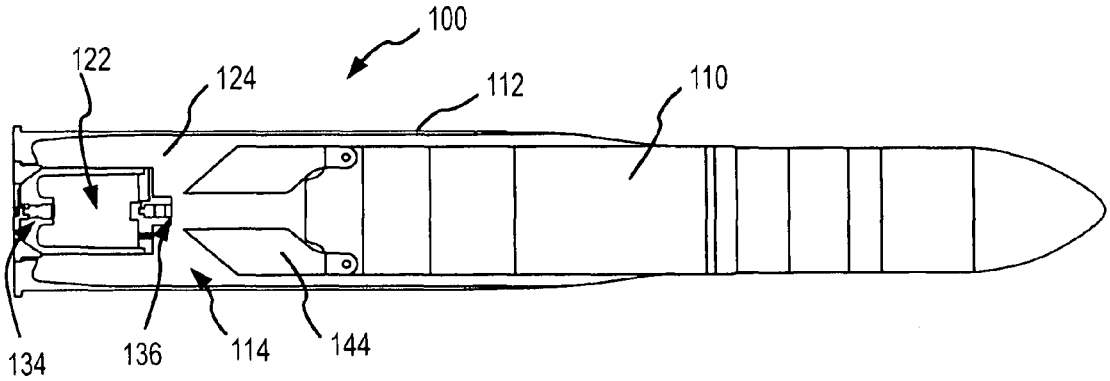
FIGS. 4 and 5 are diagrams of an exemplary cartridge having two chambers.

The projectile 110 may comprise any appropriate component to be fired from the cartridge case 112, and may be of any type, shape, and material for a particular application or environment. For example, the projectile 110 may be guided or unguided, may be ballistically or aerodynamically shaped, and may comprise any material suitable for the purpose of the projectile, for example, lead, steel, titanium, plastic, rubber, Teflon, or any combination of materials. The projectile 110 may be guided in any manner, for example, by barrel rifling, barrel aim, wire control, and/or autonomous guiding apparatus. In an exemplary embodiment, the projectile 110 comprises an autonomous guided projectile, made primarily from metal, weighing between 40 and 50 pounds and configured to be launched through a gun barrel. The projectile 110 may have fins 144 (FIG. 4), to aid accuracy of flight and provide flight control surfaces. The projectile 110 may be similar in shape, size, and weight to projectiles used in conventional fixed ammunition weapon systems, such as cannon and small arms.

The cartridge case 112 may comprise any suitable system for holding the propelling system 114 and/or the projectile 110 in position. The cartridge case 112 may be of any type, shape, and material appropriate for the particular environment or application. The cartridge case 112 may fasten securely to the projectile 110 until launch, and may be single-use or reloadable. The exterior of the cartridge case 112 may be similar in shape, size, and materials to conventional fixed ammunitions for use in conventional weapon systems, such as conventional cannon and small arms. In one embodiment, the cartridge case 112 holds the projectile 110 in an immobile, non-adjustable position until the projectile is launched, such that the cartridge case 112 and the exposed part of the projectile 110 (if any) form a single integrated unit for pre-launch handling.

The propelling system 114 may be configured in any suitable manner to project the projectile 110. The propelling system 114 may be of any type and may be activated in any suitable manner. The propelling system 114 may also be positioned in any location with respect to the cartridge case 112 and the projectile 110. In the present exemplary embodiment, the propelling system 114 is largely inside the cartridge case 112. In an alternative embodiment, the propelling system 114 may be located external to the cartridge case 112 and the cartridge case 112 functions as a conduit between the propelling system 114 and the projectile 110.

Figure 3:
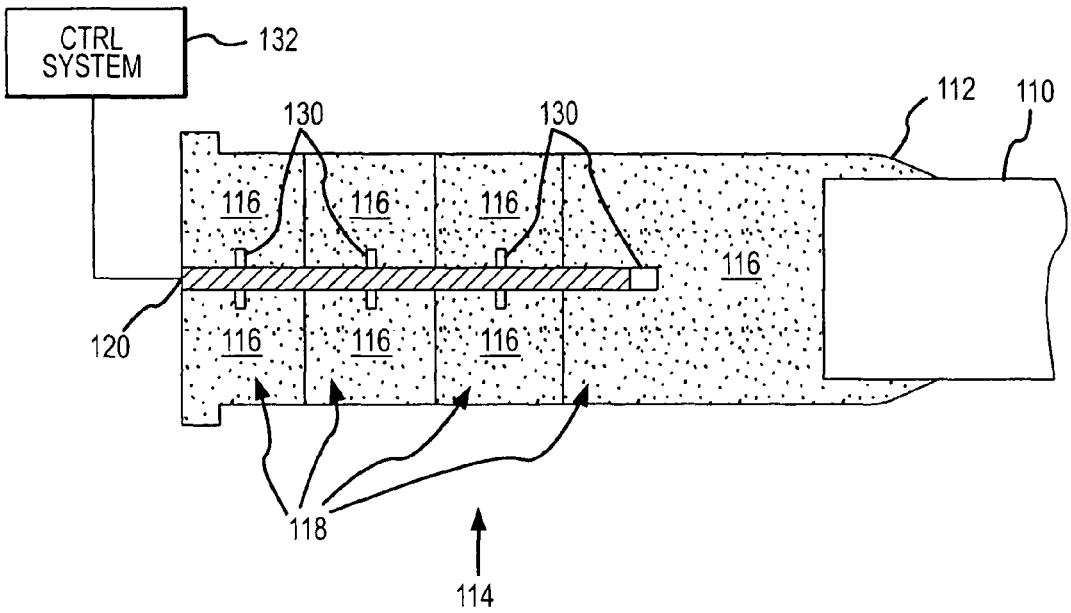

Referring to FIG. 3, the propelling system 114 of the present embodiment is configured to provide a selectable launch velocity for the projectile 110 by providing multiple propellants or zones of propellants that may be individually activated to propel the projectile. For example, the propelling system 114 may comprise multiple chambers 116 within the cartridge case 112, each containing a propellant 118, and an activation system 120. The chambers 116 divide and separate the propellant 118 into separately ignitable increments of propulsion power, such that the launch velocity of the projectile 110 is controlled by the number of chambers of propellant that may be substantially simultaneously ignited. Igniting a single chamber 116 launches the projectile 110 at minimum velocity. Igniting all chambers 116 substantially simultaneously launches the projectile 110 at maximum velocity. Igniting more than one chamber 116, but less than the maximum number of chambers 116 propels the projectile 110 at a launch velocity greater than the minimum velocity and less than the maximum velocity.

The physical arrangement of the chambers 116 may be selected according to any suitable criteria. Any number of chambers 116 may be partially or fully enclosed within a larger chamber 116. Additionally, any number of chambers 116 may be enclosed in a nested fashion where a smaller chamber 116 is enclosed in a larger chamber, which in turn is enclosed by an even larger chamber, and so forth. For example, referring to FIG. 4, in one embodiment, chamber 122 is placed at least partially inside chamber 124, such that the smaller chamber 122 is partially enclosed within the larger chamber 124. Referring again to FIG. 3, the chambers 116 may also be placed adjacent to and/or nearby other chambers 116. For example, one chamber 116 may have multiple chambers around its circumference, or chambers 116 may be layered adjacent to each other. Each chamber 116 may be of any appropriate volume, and various chambers 116 may have substantially equivalent volumes. The volume of each chamber 116 may be selected according to any relevant criteria, such as the volume available for a propelling system 114 in the cartridge case 112, the placement of each chamber, or controlling the ignition of the propellant 118 in the chambers 116.

One or more chambers 116 contain the propellant 118. The propellant 118 may comprise any suitable material for driving the projectile, such as explosive or combustible substances. The quantity of propellant 118 in each chamber 116 may be related to the volume of each chamber 116. For example, referring to FIG. 5, a rear chamber 122 is fully loaded with propellant 126, but the rear chamber 122 may not hold as much propellant 128 as a fully loaded larger forward chamber 124. Each chamber 116 may hold the same or different amount and/or type of propellant 118. Therefore, the propellant 118 type may be selected to enable each chamber 116, regardless of size, to produce substantially equivalent propelling force or other desired propelling force upon ignition.

For example, referring again to FIG. 5, the rear propellant 126 of the rear chamber 122 may have greater explosive power than the forward propellant 128 of the forward chamber 124, such that the propelling force provided by igniting the rear propellant 126 is greater than or equal to the propelling force provided by igniting the forward propellant 128, even though the rear chamber 122 may be smaller in volume than the forward chamber 124. Additionally, any suitable mixture of propellant 118 may be placed in any chamber 116 to provide a desired propelling force at ignition.

The number of possible launch velocities may correspond to the number of propellant 118 zones. A greater number of independently ignitable zones may provide a wider selection of launch velocities. The composition of the propellant 118 in the propelling system may also contribute to a variety of selectable launch velocities. For example, chambers 116 of smaller size may have propellant 118 that is proportionally stronger in firepower, such that a larger chamber 116 may have substantially equivalent firepower as a smaller chamber 116. Each chamber 116 may propel the projectile with substantially the same amount of force, creating a substantially linear relationship between the number of chambers 116 fired and the launch velocity. Additionally, chamber construction may provide additional variables to select launch velocity. For example, some chambers 116 may be constructed to remain intact until the propellant 118 ignited inside the chamber 116 attains greater pressure, thus enabling some chambers 116 to provide greater propelling power than others and a greater variety of launch velocities when used in combination.

Figure 5:
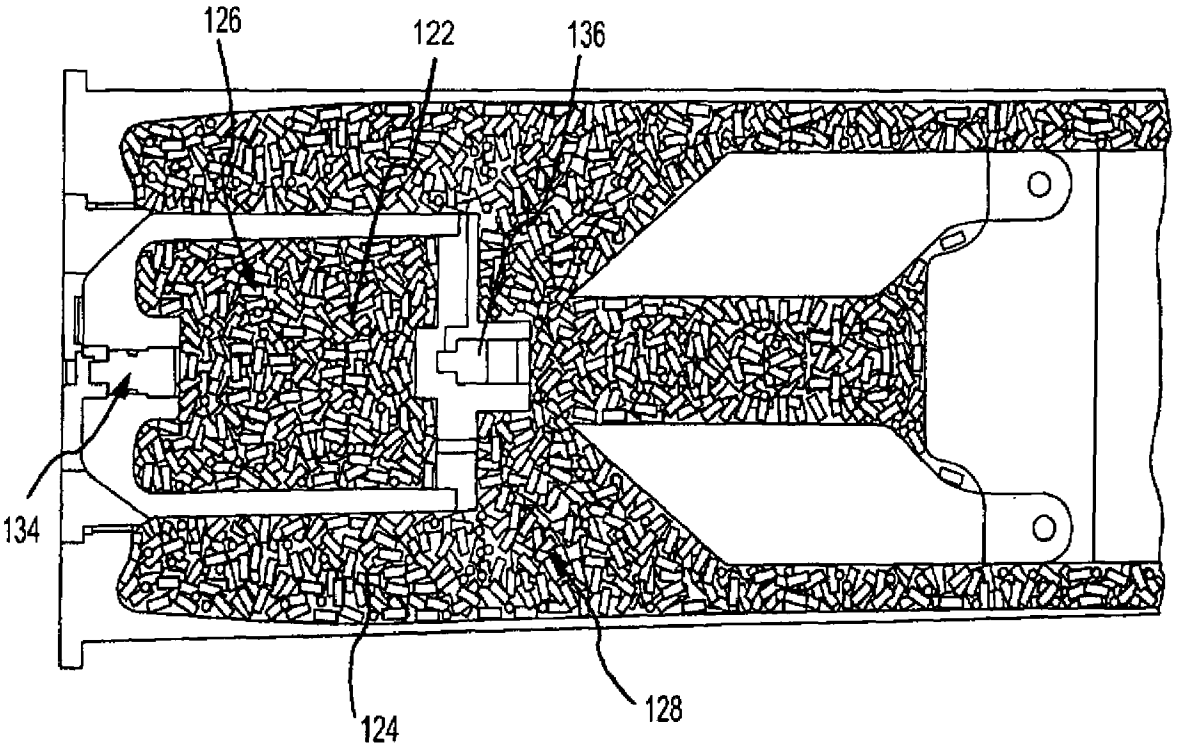

Referring to FIG. 5, the present exemplary propelling system 114 includes two chambers 122, 124. At least one of the chambers 122, 124 contains a propellant 126, 128 that may be ignited without igniting the propellant in the other chamber. To generate a high projectile 110 velocity, the propellants 126, 128 in both chambers 122, 124 are ignited substantially simultaneously. For a lower velocity, only the forward propellant 128 in the forward chamber 124 is ignited.

The activation system 120 controls the activation of the propellant 118 in the chambers 116. The activation system 120 may control the activation of the propellant in the chambers 116 in any way, and may ignite the various chambers 116 according to any appropriate process and/or sequence. For example, the activation system 120 may comprise, referring to FIG. 3, one or more igniters 130 and a control system 132. The igniters 130 ignite the propellant 118 in the chambers 116, and the control system 132 controls the activation of the igniters 130.

In an exemplary embodiment, each chamber 116 has at least one igniter 130, though a chamber 116 may not have an igniter 130 if the propellant 118 in the chamber 116 is configured to react to another stimulus, such as ignition of propellant 118 an adjacent chamber 116. For example, referring to FIG. 5, the forward chamber 124 may be positioned such that the pressure and heat caused by igniting the rear propellant 126 in the rear chamber 122 using a rear igniter 134 causes the forward propellant 128 in the forward chamber 124 to ignite without using a forward second igniter 136. Any method may be used to ignite the propellants 118 in the various chambers 116, including direct ignition by an igniter 130 directly controlled by the control system 132 or by placement of the chambers 116 such that the ignited propellant 118 ignites propellant 118 in other chambers 116.

The igniters 130 may comprise any suitable device or system for activating the propellant 118, such as an electrical igniter, a thermal igniter, a concussive igniter, an actuator, or other suitable system. Different types of igniters 130 may be used for different chambers 116 and/or types of propellants 118. For example, the igniter 130 may comprise a firing cap used in a conventional center-fire ammunition cartridge. Heat and pressure from a firing cap may be used to ignite the propellant 118 in the chamber 116. The activation system 120 may also include wires, conduits, mechanical connections, and the like through the cartridge case 112 to transport heat, electrical signals, force, pressure, or other suitable trigger signals from a firing cap or other mechanism to a chamber 116 within the cartridge case 112 or enclosed by another chamber 116. Alternatively, the igniters 130 may activate the propellant 118 and/or be activated by electrical and/or electronic signals. Electrical and/or electronic igniters 130 may be analog or digital by nature and may use any suitable voltage, current, frequency, or other parameter.

In the present embodiment, the igniters 134, 136 ignite the propellant 118 of the respective chambers 122, 124 independently of each other. Igniting the propellant in selected chambers 116 independently of other chambers 116 may allow the projectile 110 to launch at selectable launch speeds. For example, igniting the propellant 126, 128 in the rear chamber 122 and forward chamber 124 substantially simultaneously may launch the projectile 110 at a substantially maximum velocity. Igniting the forward propellant 128 of the forward chamber 124 without concurrently igniting the rear propellant 126 in the rear chamber 122 may launch the projectile 110 with a lower velocity. In an exemplary embodiment, igniting only the forward propellant 128 launches the projectile 110 at about 300 meters per second, whereas igniting both propellants 126, 128 launches the projectile 110 at 600 meters per second.

The control system 132 controls the igniters 130 to selectively activate the propellants 118 in the various chambers 116. Any type of connector may be used between the control system 132 and the igniter 130. The control system 132 may control each igniter individually, subsets of igniters, or all igniters simultaneously. Where individual or separate groups of igniters 130 may be controlled, the control system 132 may impose any appropriate timing relationship on the ignition of any igniter 130 and/or group of igniters 130 with respect to any other igniter 130 and/or group of igniters 130. For example, the control system 132 may impose a wait period between the activation of the various igniters 130, and the igniters 130 may be activated in any suitable order.

In a propelling system 114 where each igniter 130 may be activated exclusive of any other igniter 130, any method may be used to control the activation of the igniters 130. For example, the control system 132 may include an activation circuit for generating and/or routing signals to selected igniters 130. For example, separate, individual wires or other connections may connect the control system 132 to each igniter 130, and the control system 132 may generate individual signals to selectively activate each igniter 130.

Figure 6:
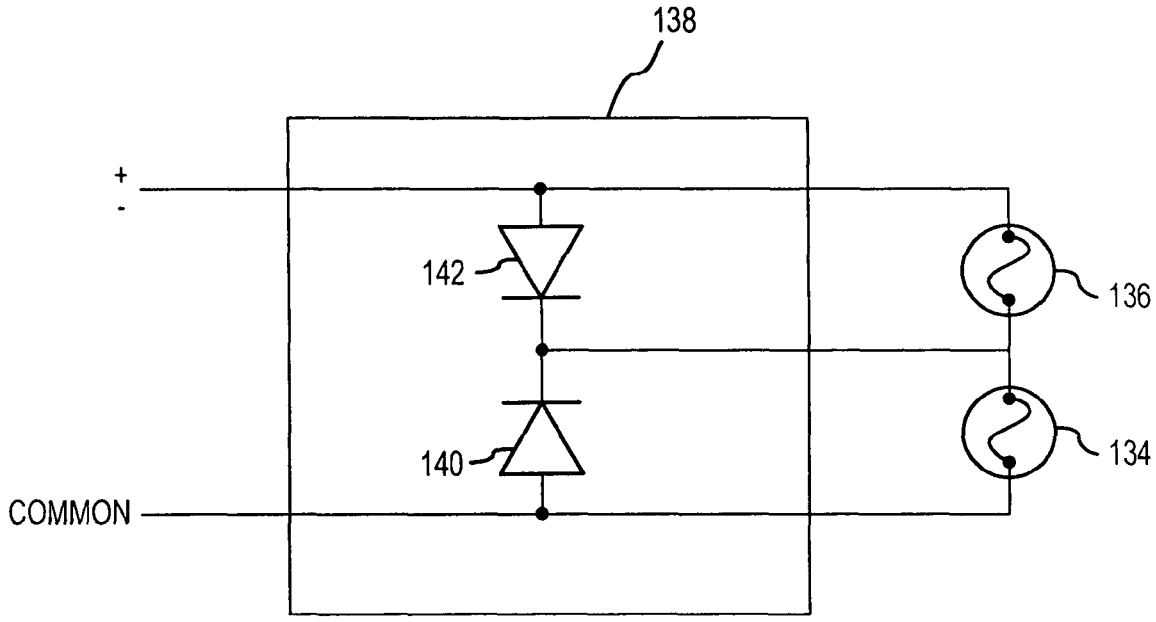
FIG. 6 is a diagram of an exemplary control system.

Referring to FIG. 6, the control system 132 may comprise a diode steering network 138 comprising first and second diodes 140, 142 that directs electrical firing pulses to the igniters 130. In the present embodiment, a positive pulse applied to the diode steering network 138 activates causes first diode 142 to conduct, causing the electrical signal to be applied to the rear igniter 134 and ignites the rear propellant 126 in the rear chamber 122. The heat and pressure from the ignited rear propellant 126 in turn ignites the forward propellant 128 in the chamber 124 without using igniter 136. In another embodiment, the forward and rear propellants 126, 128 in the chambers 122, 124 may be ignited substantially simultaneously by substantially simultaneously activating the igniters 134, 136.

Conversely, a negative firing pulse causes the second diode 140 to conduct and apply the signal to the forward igniter 136, which in turn ignites the propellant 128 in the forward chamber 124. The pressure and heat from the forward propellant 128 detonating in the forward chamber 124 do not ignite the rear propellant 126 in the rear chamber 122. Consequently, the projectile 110 is propelled using the propulsive force of only the propellant 128.

In an exemplary embodiment, firing the variable-speed projectile 110 comprises loading the cartridge 100 into a weapon system, selecting the desired launch velocity, activating the propelling system 114 in a manner to launch a projectile 110 at a desired launch speed, and launching the projectile 110. The propelling process may further include igniting propellant 118 in all unignited chambers 116 to expend all propellants 118 in the propelling system 114 to increase the safety of handling the spent cartridge 100, and removing the inert cartridge 100 from the weapon system.

Loading the cartridge 100 into a weapon system may be done in any suitable manner. For example, the cartridge 100 may be loaded manually by a single operator or multiple operators, automatically using equipment that requires no human intervention, and/or by a combination of automatic and manual methods. The method of loading ammunition in a weapon system may be combined with the process of unloading a previously fired cartridge case. In the present embodiment, an autoloader places the cartridge 100 into the weapon system.

Any available information may be used to determine a suitable launch velocity, and actual selection of the desired launch velocity may be accomplished in any suitable manner. For example, launch velocity may be related to a desired range, proximity of a target, time for a guided projectile to acquire the target, and desire to avoid detection. Once the desired velocity is determined, the velocity may be selected or communicated to the control system 132, for example by manually setting switches, automatic transfer from range finding equipment, transfer from separate location over a secure or insecure link, and a combination of automatic and manual techniques.

The propelling system 114 may be activated in any suitable manner that enables the projectile 110 to be launched at the selected launch velocity. The propelling system 114 may be activated, for example, by pulling a trigger to activate the igniters 130, waiting for the weapon system to acquire a target and automatically activating the propelling system 114 electronically, and manually activating the control system 132 that electrically activates the propelling system 114. In the present embodiment, selecting a high velocity causes the control system 132 to generate a positive electric pulse through the second diode 142 and rear igniter 134, which ignites the rear propellant 126 in the rear chamber 122. The detonation of the rear propellant 126 in the rear chamber 122 causes the forward propellant 128 in the forward chamber 124 to also detonate, propelling the projectile 110 with the combined force of both propellants 126, 128. The cartridge case 112 is inert after launch because all propellant 118 has been expended. Selecting a low velocity causes the control system 132 to generate a negative electric pulse that routes a signal through the first diode 140 and forward igniter 136, igniting the forward propellant 128 in the forward chamber 124. The projectile 110 is propelled with the force generated by forward propellant 128 alone.

After the projectile is launched at the desired velocity, propellant 118 remaining in propelling system 114 may be expended to make the cartridge 100 safer to handle. Expending remaining propellant 118 may be accomplished in any suitable manner. For example, the operator or control system 132 may track which chambers 116 were ignited to propel the projectile 110 and ignite the propellant 118 in chambers 116 that were not ignited. Alternatively, the operator or control system 132 may ignite all chambers 116 after the projectile 110 is launched to ensure the propelling system 114 is inert. In the present embodiment, propelling projectile 110 at a low speed leaves the rear propellant 126 intact in the rear chamber 122. After the projectile 110 is launched and has cleared the weapons system, the control system 132 may generate a positive electric pulse to ignite the rear propellant 126. The expanding gas generated by detonating propellant 126 exhausts out the barrel of the weapon system.

The used cartridge 100 may be unloaded from the weapon system in any suitable manner, for example, either mechanically, manually, or a combination of mechanical and manual activities. The unloading procedure may be, for example, the inverse of the loading procedure. The unloading procedure may be combined with the loading procedure for the next cartridge 100. In the present embodiment, an autoloader ejects the inert cartridge 100 from the weapon system.

Although the description above contains many details, these should not be construed as limiting the scope of the invention but as merely providing illustrations of some of the exemplary embodiments of this invention. The scope of the present invention fully encompasses other embodiments, and is accordingly to be limited by nothing other than the appended claims, in which reference to an element in the singular is not intended to mean "one and only one" unless explicitly so stated, but rather "one or more." All structural, chemical, and functional equivalents to the elements of the above-described exemplary embodiments are expressly incorporated by reference and are intended, unless otherwise specified, to be encompassed by the claims. Moreover, it is not necessary for a device or method to address each and every problem sought to be solved by the present invention for it to be encompassed by the present claims. Furthermore, no element, component, or method step in the present disclosure is intended to be dedicated to the public regardless of whether the element, component, or method step is explicitly recited in the claims. No claim element is to be construed under the provisions of 35 U.S.C. 112, sixth paragraph, unless the element is expressly recited using the phrase "means for." The terms "comprises", "comprising", or any other variation, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A munition, comprising:

a cartridge case;

a projectile attached to the cartridge case, wherein the projectile is separated from the cartridge case upon firing of the munition; and a first propellant and a second propellant disposed within the cartridge case and detached from the projectile, wherein:

one propellant may be activated without activating the other propellant; and any propellant not activated upon firing of the munition is configured to be activated after the projectile has moved away from the cartridge ease.

2. The munition of claim 1, wherein the projectile comprises a guided projectile.

3. The munition of claim 1, wherein:

the first propellant is in a first chamber in the cartridge case; and the second propellant is in a second chamber in the cartridge case.

4. The munition of claim 3, wherein the first chamber is at least partially within the second chamber.

5. The munition of claim 3, wherein the first chamber is at least partially between the projectile and the second chamber.

6. The munition of claim 1, wherein:

the first propellant is configured to activate the second propellant when the first propellant is activated; and the second propellant is configured to leave the first propellant substantially unactivated when the second propellant is activated.

7. The munition of claim 1, wherein the case is configured to fit a gun, wherein the gun may fire at least one other type of munition.

8. The munition of claim 1, further comprising:

a first activator configured to activate the first propellant; and a second activator configured to activate the second propellant.

9. The munition of claim 8, wherein the first activator and the second activator comprise igniters.

10. The munition of claim 8, wherein:

the first activator responds to a signal having a first polarity; and the second activator responds to a signal having a second polarity.

11. A weapon system, comprising:

a munition, including:

a cartridge case;

a projectile attached to the cartridge case, wherein the projectile is separated from the cartridge case upon firing of the munition; and a propelling system including a first propellant disposed within the cartridge case and detached from the projectile and a second propellant disposed within the cartridge case and detached from the projectile for moving the projectile; and a control system selectably connected to the munition, wherein the control system:

may activate one propellant without activating the other propellant; and is configured to activate any propellant not activated upon firing of the munition after the projectile has moved away from the cartridge case.

12. The weapon system of claim 11, wherein the control system applies a signal of a first polarity to activate the one propellant and a signal of a second polarity to activate the first propellant and the second propellant substantially simultaneously.

13. The weapon system of claim 11, wherein the projectile comprises a guided projectile.

14. The weapon system of claim 11, wherein:

the first propellant is in a first chamber in the cartridge case; and the second propellant is in a second chamber in the cartridge case.

15. The weapon system of claim 14, wherein the first chamber is at least partially within the second chamber.

16. The weapon system of claim 14, wherein the first chamber is at least partially between the projectile and the second chamber.

17. The weapon system of claim 11, wherein:

the first propellant is configured to activate the second propellant when the first propellant is activated; and the second propellant is configured to leave the first propellant substantially unactivated when the second propellant is activated.

18. The weapon system of claim 11, wherein:

the weapon system includes a gun, wherein the gun may fire at least one other type of munition; and the case is configured to fit the gun.

19. The weapon system of claim 11, further comprising:

a first activator configured to activate the first propellant; and a second activator configured to activate the second propellant.

20. The weapon system of claim 19, wherein the first activator and the second activator comprise igniters.

21. The weapon system of claim 19, wherein the control system may selectively activate the first activator and the second activator.

22. A cartridge, comprising:

a projectile;

a cartridge case attached to the projectile, wherein the cartridge case is separated from the projectile upon firing of the cartridge;

at least two chambers positioned inside the cartridge case;

a propellant in each of the at least two chambers, wherein the at least two chambers are disposed within the case and detached from the projectile;

at least two igniters, wherein each igniter is configured to selectively ignite the propellant in at least one of the chambers;

an ignition system, wherein the at least two igniters are responsive to the ignition system to individually selectively activate the at least two igniters, wherein:

one propellant may be left unignited until after the cartridge case and the projectile have been separated; and the unignited propellant is configured to be activated after the projectile has moved away from the cartridge case.

23. The cartridge of claim 22, wherein a launch velocity of the projectile is substantially proportional to the number of chambers ignited.

24. The cartridge of claim 22, wherein the projectile includes a guided projectile.

25. The cartridge of claim 22, wherein a first chamber is positioned substantially inside a second chamber and the first chamber is at least partially surrounded by the propellant of the second chamber.

26. The cartridge of claim 25, wherein igniting the propellant of the second chamber individually produces a launch velocity that is less than a substantially maximum launch velocity.

27. The cartridge of claim 25, wherein igniting the propellant of the first chamber causes the propellant of the second chamber to ignite.

28. The cartridge of claim 22, wherein the at least two chambers comprise a first chamber disposed at least partially between the projectile and a second chamber.

* * * * *

UNITED STATES PATENT AND TRADEMARK OFFICE

CERTIFICATE OF CORRECTION

PATENT NO. : 7,905,178 B2
APPLICATION NO. : 11/032929
DATED : March 15, 2011
INVENTOR(S) : Dryer et al.

It is certified that error appears in the above-identified patent and that said Letters Patent is hereby corrected as shown below:

In column 8, claim 1, line 22, please delete “ease” and insert --case.--

Signed and Sealed this
Seventeenth Day of May, 2011

David J. Kappos

David J. Kappos
*Director of the United States Patent and Trademark Office*